US010351810B2

(12) United States Patent
Maes et al.

(10) Patent No.: US 10,351,810 B2
(45) Date of Patent: Jul. 16, 2019

(54) COMPACTED LIQUID LAUNDRY TREATMENT COMPOSITION

(71) Applicant: The Procter & Gamble Company, Cincinnati, OH (US)

(72) Inventors: Jef Annie Alfons Maes, Sint-Niklaas (BE); Jean-Francois Bodet, Waterloo (BE); Bruno Jean-Pierre Matthys, Brussels (BE); Gregory Scot Miracle, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/205,015

(22) Filed: Jul. 8, 2016

(65) Prior Publication Data

US 2017/0009191 A1 Jan. 12, 2017

(30) Foreign Application Priority Data

Jul. 9, 2015 (EP) ..... 15175977

(51) Int. Cl.

| | |
|---|---|
| ***C11D 1/72*** | (2006.01) |
| ***C11D 1/825*** | (2006.01) |
| ***C11D 3/42*** | (2006.01) |
| ***C11D 17/04*** | (2006.01) |
| ***C11D 3/40*** | (2006.01) |
| ***C11D 3/43*** | (2006.01) |

(52) U.S. Cl.

CPC ..... *C11D 17/042* (2013.01); *C11D 1/825* (2013.01); *C11D 3/40* (2013.01); *C11D 3/42* (2013.01); *C11D 3/43* (2013.01); *C11D 17/043* (2013.01); *C11D 1/72* (2013.01); *C11D 1/721* (2013.01)

(58) Field of Classification Search

CPC ..... C11D 1/72; C11D 1/721; C11D 1/825; C11D 3/42; C11D 17/042; C11D 17/045

See application file for complete search history.

(56) References Cited

U.S. PATENT DOCUMENTS

| | | | | |
|---|---|---|---|---|
| 2011/0240510 | A1 | 10/2011 | De Poortere et al. | |
| 2013/0177518 | A1 | 7/2013 | Nielsen al. | |
| 2014/0155312 | A1* | 6/2014 | Soontravanich | B08B 1/00 510/356 |
| 2015/0111808 | A1 | 4/2015 | Miracle | |

FOREIGN PATENT DOCUMENTS

| | | | | |
|---|---|---|---|---|
| JP | 2002003897 | * | 1/2002 | C11D 17/04 |
| JP | 2002003897 | A | 1/2002 | |
| WO | WO 2007/111898 | * | 10/2007 | C11D 3/20 |
| WO | WO2007111898 | A2 | 10/2007 | |

OTHER PUBLICATIONS

PCT Search Report for Application No. PCT/US2016/040927, dated Oct. 5, 2016, 11 pages.

RU Search Report for appl. 2017145624, dated Jul. 5, 2016, 2 pages.

* cited by examiner

*Primary Examiner* — Brian P Mruk

(74) *Attorney, Agent, or Firm* — Gregory S. Darley-Emerson

(57) ABSTRACT

A water-soluble unit dose article comprising a water-soluble film and a laundry treatment composition, wherein said laundry treatment composition includes: between 0.0001% and 8% by weight of the composition of a non-surfactant benefit agent; and between 40% and 80% by weight of the composition of an alkoxylated alkyl surfactant system.

20 Claims, No Drawings

COMPACTED LIQUID LAUNDRY TREATMENT COMPOSITION

FIELD OF THE INVENTION

Liquid laundry treatment compositions.

BACKGROUND OF THE INVENTION

Often, non-surfactant benefit agents are formulated into liquid laundry treatment compositions. Such benefit agents include technologies such as hueing dyes, enzymes, brighteners, soil release polymers, chelants and mixtures thereof. However, upon addition of the liquid composition to the wash liquor such benefit agents can exhibit poor dispersion characteristics and so form localized areas of high concentration of said ingredients.

This has the negative effect of reducing the effectiveness the benefit agent can provide to all the fabrics present in the wash liquor and so negatively affect the consumer wash experience. In the case of benefit agents such as hueing dyes, this localized high concentration can also cause localized spot staining on fabrics. This staining is a result of the high concentration of hueing dye in prolonged contact with a particular area of fabric.

This issue can be especially problematic when the liquid laundry treatment composition is formulated into one or more compartments of a water-soluble unit dose article.

Thus, there is a need in the art for the provision of a water-soluble unit dose composition comprising non-surfactant benefit agents, which exhibits reduced localized high concentrations of said benefit agents in the wash liquor.

The Inventors surprisingly found that the compositions of the present invention exhibited improved dispersion of benefit agents in the wash liquor and reduced instances of localized high concentrations of said actives in the wash liquor.

SUMMARY OF THE INVENTION

The present invention is to a water-soluble unit dose article comprising a water-soluble film and a laundry treatment composition, wherein said laundry treatment composition comprises;

a. Between 0.0001% and 8% by weight of the composition of a non-surfactant benefit agent;

b. Between 40% and 80% by weight of the composition of an alkoxylated alkyl surfactant system, wherein the alkoxylated alkyl surfactant comprise a first alkoxylated alkyl surfactant and a second alkoxylated alkyl surfactant, wherein;

i. the first surfactant has the general structure R-A, where R is a linear or branched alkyl chain having a chain length of between 6 and 18 carbon atoms, A is at least one alkoxy group having an average degree of alkoxylation of between 2 and 12 and wherein the alkoxy groups consists of identical repeat alkoxy groups or identical repeat alkoxy group blocks wherein a block comprises at least two alkoxy groups;

ii. the second surfactant has the general structure R'-E-C, wherein R' is a linear or branched alkyl chain having a chain length of between 6 and 18 carbon atoms, E is an ethoxy chain consisting of between 2 and 12 ethoxy groups and C is an end cap, wherein the end cap is selected from;

I. an alkyl chain consisting of between 1 and 8 alkoxy groups selected from propoxy groups, butoxy groups and a mixture thereof; or II. an —OH group; or III. a linear or branched alkyl chain of the general formula R" wherein R" consists of between 1 and 8 carbon atoms;

IV. or a mixture thereof;

c. Between 0% and 40% by weight of the composition of a solvent, wherein the solvent is selected from polar protic solvents, polar aprotic solvents or a mixture thereof.

DETAILED DESCRIPTION OF THE INVENTION

Water-Soluble Unit Dose Article

The present invention is to a water-soluble unit dose article. The water-soluble unit dose article comprises a water-soluble film and a laundry treatment composition. The water-soluble film is described in more detail below. The laundry treatment composition is described in more detail below.

The water-soluble unit dose article comprises at least one water-soluble film shaped such that the unit-dose article comprises at least one internal compartment surrounded by the water-soluble film. The at least one compartment comprises the laundry treatment composition. The water-soluble film is sealed such that the laundry treatment composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the composition. Preferably, the unit dose article comprises a water-soluble film. The unit dose article is manufactured such that the water-soluble film completely surrounds the composition and in doing so defines the compartment in which the composition resides. The unit dose article may comprise two films. A first film may be shaped to comprise an open compartment into which the composition is added. A second film is then laid over the first film in such an orientation as to close the opening of the compartment. The first and second films are then sealed together along a seal region. The film is described in more detail below.

The unit dose article may comprise more than one compartment, even at least two compartments, or even at least three compartments. The compartments may be arranged in superposed orientation, i.e. one positioned on top of the other. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the composition according to the present invention may be comprised in at least one of the compartments. It may for example be comprised in just one compartment, or may be comprised in two compartments, or even in three compartments.

Each compartment may comprise the same or different compositions. The different compositions could all be in the same form, for example they may all be liquid, or they may be in different forms, for example one or more may be liquid and one or more may be solid.

The laundry treatment composition according to the present invention may be present in one compartment or may be present in more than one compartment.

Laundry Treatment Composition

The present invention is to a laundry treatment composition. The laundry treatment composition may be any suitable composition. The composition may be in the form of a solid, a liquid, or a mixture thereof.

A solid can be in the form of free flowing particulates, compacted solids or a mixture thereof. It should be understood, that a solid may comprise some water, but is essentially free of water. In other words, no water is intentionally added other than what comes from the addition of various raw materials.

In relation to the laundry treatment composition of the present invention, the term 'liquid' encompasses forms such as dispersions, gels, pastes and the like. The liquid composition may also include gases in suitably subdivided form. The term 'liquid laundry treatment composition' refers to any laundry treatment composition comprising a liquid capable of wetting and treating fabric e.g., cleaning clothing in a domestic washing machine. A dispersion for example is a liquid comprising solid or particulate matter contained therein.

The laundry treatment composition can be used as a fully formulated consumer product, or may be added to one or more further ingredient to form a fully formulated consumer product. The laundry treatment composition may be a 'pre-treat' composition which is added to a fabric, preferably a fabric stain, ahead of the fabric being added to a wash liquor.

The laundry treatment composition comprises between 0.0001% and 8% by weight of the composition of a non-surfactant benefit agent. The non-surfactant benefit agent is described in more detail below.

The laundry treatment composition comprises between 40% and 80% by weight of the composition of an alkoxylated alkyl surfactant system, wherein the alkoxylated alkyl surfactant system comprises a first alkoxylated alkyl surfactant and a second alkoxylated alkyl surfactant. The alkoxylated alkyl surfactant system is described in more detail below.

The laundry treatment composition comprises between 0% and 40% by weight of the composition of a solvent, wherein the solvent is selected from polar protic solvents, polar aprotic solvents or a mixture thereof. The solvent is described in more detail below.

Without wishing to be bound by theory, it is believed that the non-surfactant benefit agent complexes with the alkoxylated alkyl surfactant system to form a micellar structure. In the form of these micelle structures, the non-surfactant benefit agent is better dispersed in the wash liquor and less likely to form areas of high localized concentration.

Non-Surfactant Benefit Agent

By 'non-surfactant benefit agent' we herein mean any compound that provides a benefit to the fabrics, such as cleaning, freshness, aesthetics or the like, and that does not exhibit surfactant properties. Surfactants are organic molecules with a hydrophobic tail (Alkyl-like which is oil soluble) and a hydrophilic part (water soluble). Surfactants exhibit the ability to lower surface tension and can form micelles and other phases such as hexagonal.

The liquid composition comprises between 0.0001% and 8% by weight of the composition of a non-surfactant benefit agent. The liquid composition may comprise between 0.0005% and 6% or even between 0.001% and 5% by weight of the composition of the non-surfactant benefit agent.

The non-surfactant benefit agent may be any suitable non-surfactant benefit agent. Those skilled in the art would recognize suitable non-surfactant benefit agents.

Preferably, the non-surfactant benefit agent has a hydrophilic index of between 6 and 16, more preferably between 8 and 14. Where there is a mixture of non-surfactant benefit agents, each benefit agent may have a hydrophilic index of between 6 and 16, more preferably between 8 and 14. Alternatively, the mixture of benefit agents taken together may have a hydrophilic index of between 6 and 16, more preferably between 8 and 14. Those skilled in the art will know how to calculate the hydrophilic index using well known equations.

The hydrophilic index of a non-surfactant benefit agent ($HI_{NS}$) can be calculated as follows;

$$\text{HI of non-surfactant benefit agent}_{y}(HI_{NSy})=20\times(\text{MW of the hydrophilic part of}_{y})/(\text{MW of}_{y})$$

Those skilled in the art will know how to recognize the hydrophilic part and calculate the appropriate molecular weights (MW).

The hydrophilic index of a mixed non-surfactant benefit agent system ($HI_{MNS}$) containing y non-surfactant benefit agents can be calculated as follows;

$$HI_{MNS}=\sum_{n=1}^{y}((\text{Wt. fraction of } NSy)(HI\ NSy))$$

For the purpose of the present invention, the following groups should be understood to be hydrophilic groups; —OH of an alcohol, $CH_2CH_2O$ from an ethoxylate, $CH_2CH(O)CH_2O$ of glycerol groups, sulphates, sulphonates, carbonates and carboxylates. The molecular weight of these in both the hydrophilic part and the overall molecule should be determined in the absence the counterion, for example $—SO_3^-$, $—CO_2^-$ and not $SO_3Na$, $SO_3H$, $CO_2H$ or $CO_2Na$. With respect to quaternary ammonium compounds, an $N^+R_4$ groups are recognized as hydrophilic groups and should be interpreted for hydrophilic index calculations as an $N^+(CH_2)_4$ group regardless of what the $R_{1-4}$ substitutions are. An ether is not recognized as a hydrophilic group unless said ether is an ethoxylate as described above. All other groups are not recognized as hydrophilic groups in relation to the present invention.

Preferably, the non-surfactant benefit agent is alkoxylated, more preferably ethoxylated.

The non-surfactant benefit agent may be selected from the group comprising hueing dyes, brighteners, soil release polymers, chelants and mixtures thereof. Preferably, the benefit agent is a hueing dye.

The hueing dye (sometimes referred to as shading, bluing or whitening agents) typically provides a blue or violet shade to fabric. Hueing dyes can be used either alone or in combination to create a specific shade of hueing and/or to shade different fabric types. This may be provided for example by mixing a red and green-blue dye to yield a blue or violet shade. Preferably the hueing dye is a blue or violet hueing dye, providing a blue or violet color to a white cloth or fabric. Such a white cloth treated with the composition will have a hue angle of 240 to 345, more preferably 260 to 325, even more preferably 270 to 310.

In one aspect, a hueing dye suitable for use in the present invention has, in the wavelength range of about 400 nm to about 750 nm, in methanol solution, a maximum extinction coefficient greater than about 1000 liter/mol/cm. In one aspect, a hueing dye suitable for use in the present invention has, in the wavelength range of about 540 nm to about 630 nm, a maximum extinction coefficient from about 10,000 to about 100,000 liter/mol/cm. In one aspect, a hueing dye suitable for use in the present invention has, in the wavelength range of about 560 nm to about 610 nm, a maximum extinction coefficient from about 20,000 to about 70,000 liter/mol/cm or even about 90,000 liter/mol/cm.

The Test Methods provided below can be used to determine if a dye, or a mixture of dyes, is a hueing dye for the purposes of the present invention.

Test Methods

I. Method for Determining Deposition for a Dye a.) Unbrightened Multifiber Fabric Style 41 swatches (MFF41, 5 cm×10 cm, average weight 1.46 g) serged with unbrightened thread are purchased from Testfabrics, Inc. (West Pittston, Pa.). MFF41 swatches are stripped prior to use by washing two full cycles in AATCC heavy duty liquid laundry detergent (HDL) nil brightener at 49° C. and washing 3 additional full cycles at 49° C. without detergent. Four replicate swatches are placed into each flask.

b.) A sufficient volume of AATCC standard nil brightener HDL detergent solution is prepared by dissolving the detergent in 0 gpg water at room temperature at a concentration of 1.55 g per liter.

c.) A concentrated stock solution of dye is prepared in an appropriate solvent selected from dimethyl sulfoxide (DMSO), ethanol or 50:50 ethanol:water. Ethanol is preferred. The dye stock is added to a beaker containing 400 mL detergent solution (prepared in step I.b. above) in an amount sufficient to produce an aqueous solution absorbance at the $\lambda_{max}$ of 0.1 AU (±0.01 AU) in a cuvette of path length 1.0 cm. For a mixture of dyes, the sum of the aqueous solution absorbance at the $\lambda_{max}$ of the individual dyes is 0.1 AU (±0.01 AU) in a cuvette of path length 1.0 cm. Total organic solvent concentration in a wash solution from the concentrated stock solution is less than 0.5%. A 125 mL aliquot of the wash solution is placed into 3 separate disposable 250 mL Erlenmeyer flasks (Thermo Fisher Scientific, Rochester, N.Y.).

d.) Four MFF41 swatches are placed into each flask, flasks are capped and manually shaken to wet the swatches. Flasks are placed onto a Model 75 wrist action shaker from Burrell Scientific, Inc. (Pittsburgh, Pa.) and agitated on the highest setting of 10 (390 oscillations per minute with an arc of 14.6°). After 12 minutes, the wash solution is removed by vacuum aspiration, 125 mL of 0 gpg water is added for a rinse, and the flasks agitated for 4 additional minutes. Rinse solution is removed by vacuum aspiration and swatches are spun in a Mini Countertop Spin Dryer (The Laundry Alternative Inc., Nashua, N.H.) for 5 minutes, after which they are allowed to air dry in the dark.

e.) L*, a*, and b* values for the 3 most consumer relevant fabric types, cotton and polyester, are measured on the dry swatches using a LabScan XE reflectance spectrophotometer (HunterLabs, Reston, Va.; D65 illumination, 10° observer, UV light excluded). The L*, a*, and b* values of the 12 swatches (3 flasks each containing 4 swatches) are averaged and the hueing deposition (HD) of the dye is calculated for each fabric type using the following equation:

$$HD=DE^*=((L^*_c-L^*_s)^2+(a^*_c-a^*_s)^2+(b^*_c-b^*_s)^2)^{1/2}$$

wherein the subscripts c and s respectively refer to the control, i.e., the fabric washed in detergent with no dye, and the fabric washed in detergent containing dye, or a mixture of dyes, according to the method described above.

II. Method for Determining Relative Hue Angle (Vs. Nil Dye Control)

a) The a* and b* values of the 12 swatches from each solution were averaged and the following formulas used to determine Δa* and Δb*:

$$\Delta a^*=a^*_c-a^*_s \text{ and } \Delta b^*=b^*_c-b^*_s$$

wherein the subscripts c and s respectively refer to the fabric washed in detergent with no dye and the fabric washed in detergent containing dye, or mixture of dyes, according to the method described in I. above.

b.) If the absolute value of both Δa* and Δb*<0.25, no Relative Hue Angle (RHA) was calculated. If the absolute value of either Δa* or Δb* were ≥0.25, the RHA was determined using one of the following formulas:

$$\text{When } \Delta b^*\geq 0, RHA=ATAN\ 2(\Delta a^*,\Delta b^*)$$

$$\text{When } \Delta b^*<0, RHA=360+ATAN\ 2(\Delta a^*,\Delta b^*)$$

III. Method to Determine if a Dye is a Hueing Dye

A dye, or mixture of dyes, is considered a hueing dye (also known as a shading or bluing dye) for the purposes of the present invention if (a) either the $HD_{cotton}$ or the $HD_{polyester}$ is greater than or equal to 2.0 DE* units or preferably greater than or equal to 3.0, or 4.0 or even 5.0, according to the formula above, and (b) the relative hue angle (see Method III. below) on the fabric that meets the DE* criterion in (a) is within 240 to 345, more preferably 260 to 325, even more preferably 270 to 310. If the value of HD for both fabric types is less than 2.0 DE* units, or if the relative hue angle is not within the prescribed range on each fabric for which the DE* meets the criteria the dye is not a hueing dye for the purposes of the present invention.

The hueing dye may be selected from any chemical class of dye as known in the art, including but not limited to acridine, anthraquinone (including polycyclic quinones), azine, azo (e.g., monoazo, disazo, trisazo, tetrakisazo, polyazo), benzodifurane, benzodifuranone, carotenoid, coumarin, cyanine, diazahemicyanine, diphenylmethane, formazan, hemicyanine, indigoids, methane, naphthalimides, naphthoquinone, nitro, nitroso, oxazine, phthalocyanine, pyrazoles, stilbene, styryl, triarylmethane, triphenylmethane, xanthenes and mixtures thereof.

Suitable hueing dyes include small molecule dyes, polymeric dyes and dye-clay conjugates. Preferred hueing dyes are selected from small molecule dyes and polymeric dyes.

Suitable small molecule dyes may be selected from the group consisting of dyes falling into the Colour Index (C.I., Society of Dyers and Colourists, Bradford, UK) classifications of Acid, Direct, Basic, Reactive, Solvent or Disperse dyes. Preferably such dyes can be classified as Blue, Violet, Red, Green or Black, and provide the desired shade either alone or in combination with other dyes or in combination with other adjunct ingredients. Reactive dyes may contain small amounts of hydrolyzed dye as sourced, and in detergent formulations or in the wash may undergo additional hydrolysis. Such hydrolyzed dyes and mixtures may also serve as suitable small molecule dyes.

In another aspect, suitable dyes may include those selected from the group consisting of dyes denoted by the Colour Index designations such as Direct Violet 5, 7, 9, 11, 31, 35, 48, 51, 66, and 99, Direct Blue 1, 71, 80 and 279, Acid Red 17, 73, 52, 88 and 150, Acid Violet 15, 17, 24, 43, 49 and 50, Acid Blue 15, 17, 25, 29, 40, 45, 48, 75, 80, 83, 90 and 113, Acid Black 1, Basic Violet 1, 3, 4, 10 and 35, Basic Blue 3, 16, 22, 47, 66, 75 and 159, anthraquinone Disperse or Solvent dyes such as Solvent Violet 11, 13, 14, 15, 15, 26, 28, 29, 30, 31, 32, 33, 34, 26, 37, 38, 40, 41, 42, 45, 48, 59; Solvent Blue 11, 12, 13, 14, 15, 17, 18, 19, 20, 21, 22, 35, 36, 40, 41, 45, 59, 59:1, 63, 65, 68, 69, 78, 90; Disperse Violet 1, 4, 8, 11, 11:1, 14, 15, 17, 22, 26, 27, 28, 29, 34, 35, 36, 38, 41, 44, 46, 47, 51, 56, 57, 59, 60, 61, 62, 64, 65, 67, 68, 70, 71, 72, 78, 79, 81, 83, 84, 85, 87, 89, 105; Disperse Blue 2, 3, 3:2, 8, 9, 13, 13:1, 14, 16, 17, 18, 19, 22, 23, 24, 26, 27, 28, 31, 32, 34, 35, 40, 45, 52, 53, 54, 55, 56, 60, 61, 62, 64, 65, 68, 70, 72, 73, 76, 77, 80, 81, 83, 84, 86, 87, 89, 91, 93, 95, 97, 98, 103, 104, 105, 107, 108, 109, 11, 112, 113, 114, 115, 116, 117, 118, 119, 123, 126, 127, 131, 132, 134, 136, 140, 141, 144, 145, 147, 150, 151, 152, 153, 154, 155, 156, 158, 159, 160, 161, 162, 163, 164, 166, 167, 168, 169, 170, 176, 179, 180, 180:1, 181, 182, 184, 185, 190, 191, 192, 196, 197, 198, 199, 203, 204, 213, 214, 215, 216, 217, 218, 223, 226, 227, 228, 229, 230, 231, 232, 234, 235, 236, 237, 238, 239, 240, 241, 242, 243, 244, 245, 246, 247, 249, 252, 261, 262, 263, 271, 272, 273, 274, 275, 276, 277, 289, 282, 288, 289, 292, 293, 296, 297, 298, 299, 300, 302, 306, 307, 308, 309, 310, 311, 312, 314, 318, 320, 323, 325, 326, 327, 331, 332, 334, 347, 350, 359, 361, 363, 372, 377 and 379, azo Disperse dyes such as Disperse Blue 10, 11, 12, 21, 30, 33, 36, 38, 42, 43, 44, 47, 79, 79:1, 79:2, 79:3, 82, 85, 88, 90, 94, 96, 100, 101, 102, 106, 106:1, 121, 122, 124, 125, 128, 130, 133, 137, 138, 139, 142, 146, 148, 149, 165, 165:1, 165:2, 165:3, 171, 173, 174, 175, 177, 183, 187, 189, 193, 194, 200, 201, 202, 206, 207, 209, 210, 211, 212, 219, 220, 224, 225, 248, 252, 253, 254, 255, 256, 257, 258, 259, 260, 264, 265, 266, 267, 268, 269, 270, 278, 279, 281, 283, 284, 285, 286, 287, 290, 291, 294, 295, 301, 304, 313, 315, 316, 317:319, 321, 322, 324, 328, 330, 333, 335, 336, 337, 338, 339, 340, 341, 342, 343, 344, 345, 346, 351, 352, 353, 355, 356, 358, 360, 366, 367, 368, 369, 371, 373, 374, 375, 376 and 378, Disperse Violet 2, 3, 5, 6, 7, 9, 10, 12, 3, 16, 24, 25, 33, 39, 42, 43, 45, 48, 49, 50, 53, 54, 55, 58, 60, 63, 66, 69, 75, 76, 77, 82, 86, 88, 91, 92, 93, 93:1, 94, 95, 96, 97, 98, 99, 100, 102, 104, 106 and 107. Preferably, small molecule dyes can be selected from the group consisting of C. I. numbers Acid Violet 17, Acid Blue 80, Acid Violet 50, Direct Blue 71, Direct Violet 51, Direct Blue 1, Acid Red 88, Acid Red 150, Acid Blue 29, Acid Blue 113 or mixtures thereof.

In another aspect suitable small molecule dyes may include dyes with CAS-No's 52583-54-7, 42783-06-2, 210758-04-6, 104366-25-8, 122063-39-2, 167940-11-6, 52239-04-0, 105076-77-5, 84425-43-4, and 87606-56-2, and non-azo dyes Disperse Blue 250, 354, 364, Solvent Violet 8, Solvent blue 43, 57, Lumogen F Blau 650, and Lumogen F Violet 570.

In another aspect suitable small molecule dyes include azo dyes, preferably mono-azo dyes, covalently bound to phthalocyanine moieties, preferably Al- and Si-phthalocyanine moieties, via an organic linking moiety.

Suitable polymeric dyes include dyes selected from the group consisting of polymers containing covalently bound (sometimes referred to as conjugated) chromogens, (also known as dye-polymer conjugates), for example polymers with chromogen monomers co-polymerized into the backbone of the polymer and mixtures thereof.

Polymeric dyes include: (a) Reactive dyes bound to water soluble polyester polymers via at least one and preferably two free OH groups on the water soluble polyester polymer. The water soluble polyester polymers can be comprised of comonomers of a phenyl dicarboxylate, an oxyalkyleneoxy and a polyoxyalkyleneoxy; (b) Reactive dyes bound to polyamines which are polyalkylamines that are generally linear or branched. The amines in the polymer may be primary, secondary and/or tertiary. Polyethyleneimine in one aspect is preferred. In another aspect, the polyamines are ethoxylated; (c) Dye polymers having dye moieties carrying negatively charged groups obtainable by copolymerization of an alkene bound to a dye containing an anionic group and one or more further alkene comonomers not bound to a dye moiety; (d) Dye polymers having dye moieties carrying positively charged groups obtainable by copolymerization of an alkene bound to a dye containing an cationic group and one or more further alkene comonomers not bound to a dye moiety; (e) Polymeric thiophene azo polyoxyalkylene dyes containing carboxylate groups; and (f) dye polymer conjugates comprising at least one reactive dye and a polymer comprising a moiety selected from the group consisting of a hydroxyl moiety, a primary amine moiety, a secondary amine moiety, a thiol moiety and combinations thereof; said polymers preferably selected from the group consisting of polysaccharides, proteins, polyalkyleneimines, polyamides, polyols, and silicones. In one aspect, carboxymethyl cellulose (CMC) may be covalently bound to one or more reactive blue, reactive violet or reactive red dye such as CMC conjugated with C.I. Reactive Blue 19, sold by Megazyme, Wicklow, Ireland under the product name AZO-CM-CELLULOSE, product code S-ACMC.

Other suitable polymeric dyes include polymeric dyes selected from the group consisting of alkoxylated triphenylmethane polymeric colourants, alkoxylated carbocyclic and alkoxylated heterocyclic azo colourants, including alkoxylated thiophene polymeric colourants, and mixtures thereof. Preferred polymeric dyes comprise the optionally substituted alkoxylated dyes, such as alkoxylated triphenyl-methane polymeric colourants, alkoxylated carbocyclic and alkoxylated heterocyclic azo colourants including alkoxylated thiophene polymeric colourants, and mixtures thereof, such as the fabric-substantive colorants sold under the name of Liquitint® (Milliken, Spartanburg, S.C., USA).

Suitable polymeric dyes are illustrated below. As with all such alkoxylated compounds, the organic synthesis may produce a mixture of molecules having different degrees of alkoxylation. During a typical ethoxylation process, for example, the randomness of the ethylene oxide addition results in a mixture of oligomers with different degrees of ethoxylation. As a consequence of its ethylene oxide number distribution, which often follows a Poisson law, a commercial material contains substances with somewhat different properties. For example, in one aspect, the polymeric dye resulting from an ethoxylation is not a single compound containing five ($CH_2CH_2O$) units as the general structure (Formula A, with x+y=5) may suggest. Instead, the product is a mixture of several homologs whose total of ethylene oxide units varies from about 2 to about 10. Industrially relevant processes will typically result in such mixtures, which may normally be used directly to provide the hueing dye, or less commonly may undergo a purification step.

Preferably, the hueing dye may be one wherein the hueing dye has the following structure:

$$\text{Dye-(G)}a\text{-NR}^1\text{R}^2,$$

wherein the -(G)a-$NR^1R^2$ group is attached to an aromatic ring of the dye, G is independently —$SO_2$— or —C(O)—, the index a is an integer with a value of 0 or 1 and $R^1$ and $R^2$ are independently selected from H, a polyoxyalkylene chain, a $C_{1-8}$ alkyl, optionally the alkyl chains comprise ether (C—O—C), ester and/or amide links, optionally the alkyl chains are substituted with —Cl, —Br, —CN, —$NO_2$, —$SO_2CH_3$, —OH and mixtures thereof, $C_{6-10}$ aryl, optionally substituted with a polyoxyalkylene chain, $C_{7-16}$ alkaryl optionally substituted with ether (C—O—C), ester and/or amide links, optionally substituted with —Cl, —Br, —CN, —$NO_2$, —$SO_2CH_3$, —OH, polyoxyalkylene chain substituted $C_{1-8}$ alkyl, polyoxyalkylene chain substituted $C_{6-10}$ aryl, polyoxyalkylene chain substituted $C_{7-16}$ alkaryl and mixtures thereof; said polyoxyalkylene chains independently having from about 2 to about 100, about 2 to about 50, about 3 to about 30 or about 4 to about 20 repeating units. Preferably, the repeating units are selected from the group consisting of ethylene oxide, propylene oxide, butylene oxide and mixtures thereof. Preferably, the repeating units are essentially ethylene oxide.

Preferably, the hueing dye may have the structure of Formula A:

Formula A

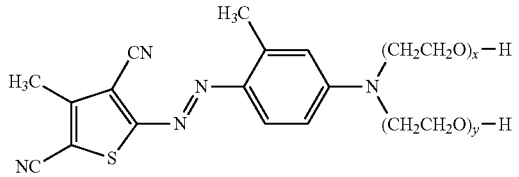

wherein the index values x and y are independently selected from 1 to 10. In some aspects, the average degree of ethoxylation, x+y, sometimes also referred to as the average number of ethoxylate groups, is from about 3 to about 12, preferably from about 4 to about 8. In some embodiments the average degree of ethoxylation, x+y, can be from about 5 to about 6. The range of ethoxylation present in the mixture varies depending on the average number of ethoxylates incorporated. Typical distributions for ethoxylation of toluidine with either 5 or 8 ethoxylates are shown in Table II on page 42 in the Journal of Chromatography A 1989, volume 462, pp. 39-47. The whitening agents are synthesized according to the procedures disclosed in U.S. Pat. No. 4,912,203 to Kluger et al.; a primary aromatic amine is reacted with an appropriate amount of ethylene oxide, according to procedures well known in the art. The polyethyleneoxy substituted m-toluidine useful in the preparation of the colorant can be prepared by a number of well-known methods. It is preferred, however, that the polyethyleneoxy groups be introduced into the m-toluidine molecule by reaction of the m-toluidine with ethylene oxide. Generally the reaction proceeds in two steps, the first being the formation of the corresponding N,N-dihydroxyethyl substituted m-toluidine. In some aspects, no catalyst is utilized in this first step (for example as disclosed at Column 4, lines 16-25 of U.S. Pat. No. 3,927,044 to Foster et al.). The dihydroxyethyl substituted m-toluidine is then reacted with additional ethylene oxide in the presence of a catalyst such as sodium (described in Preparation II of U.S. Pat. No. 3,157,633 to Kuhn), or it may be reacted with additional ethylene oxide in the presence of sodium or potassium hydroxide (described in Example 5 of U.S. Pat. No. 5,071,440 to Hines et al.). The amount of ethylene oxide added to the reaction mixture determines the number of ethyleneoxy groups which ultimately attach to the nitrogen atom. In some aspects, an excess of the polyethyleneoxy substituted m-toluidine coupler may be employed in the formation of the whitening agent and remain as a component in the final colorant mixture. In certain aspects, the presence of excess coupler may confer advantageous properties to a mixture in which it is incorporated such as the raw material, a pre-mix, a finished product or even the wash solution prepared from the finished product.

The $HI_{NS}$ for the dye of Formula A as a function of the index values x and y are given in the table below.

| Dye $A_{(x+y)}$ | x + y | MW of Dye | MW of Hydrophilic Part | $HI_{NS}$ |
|---|---|---|---|---|
| $A_2$ | 2 | 369.44 | 90.12 | 4.9 |
| $A_6$ | 6 | 545.65 | 266.33 | 9.8 |
| $A_{10}$ | 10 | 721.86 | 442.54 | 12.3 |

The HI of a mixture of A2, A6 and A10 in a weight ratio of 30:30:40 is 9.3.

The hueing dye may preferably have the following structure:

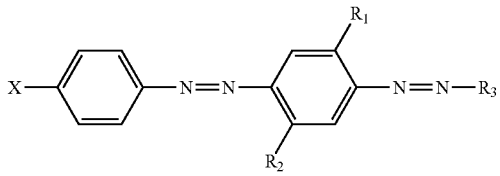

wherein:

$R_1$ and $R_2$ are independently selected from the group consisting of: H; alkyl; alkoxy; alkyleneoxy; alkyl capped alkyleneoxy; urea; and amido;

$R_3$ is a substituted aryl group;

X is a substituted group comprising sulfonamide moiety and optionally an alkyl and/or aryl moiety, and wherein the substituent group comprises at least one alkyleneoxy chain.

The hueing dye may be a thiophene dye such as a thiophene azo dye, preferably alkoxylated. Optionally the dye may be substituted with at least one solubilizing group selected from sulphonic carboxylic or quaternary ammonium groups.

Non-limiting examples of hueing dyes according to the present invention are:

Dye Formula 1

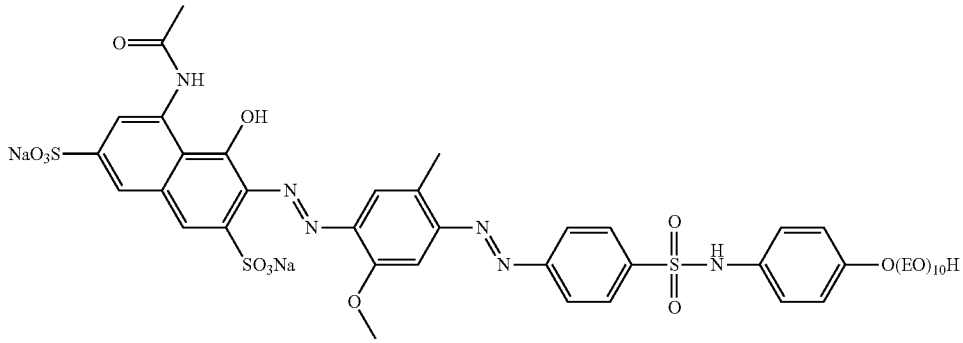

(HI = 7.8)

-continued
Dye Formula 2
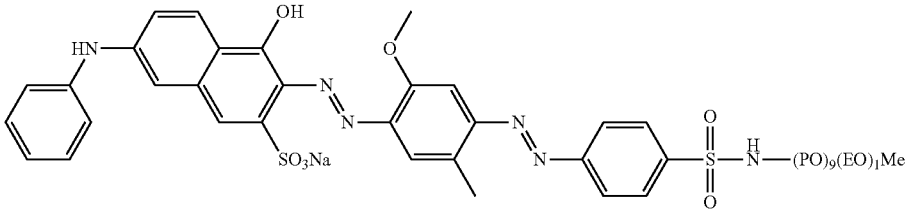
(HI = 2.3)
Dye Formula 3
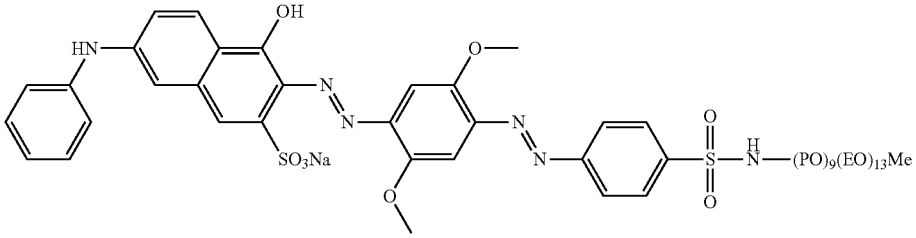
(HI = 9.8)
Dye Formula 4
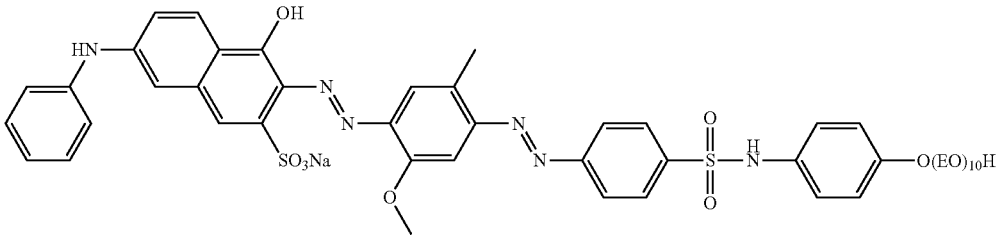
(HI = 9.4)
Dye Formula 5
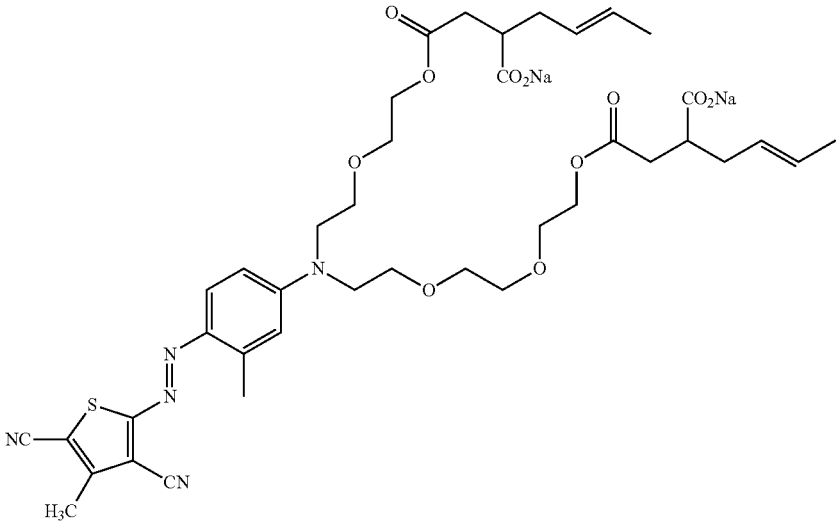
(HI = 7.6)

-continued
Dye Formula 6
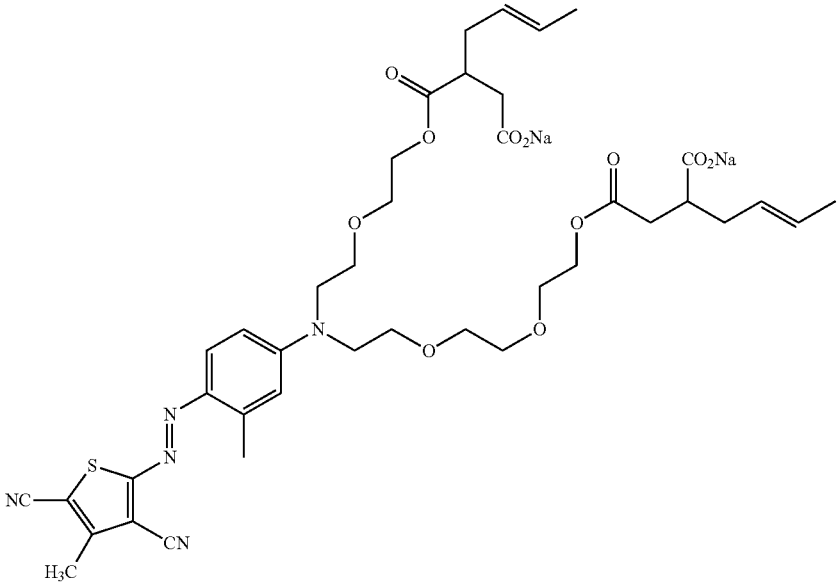
(HI = 7.6)
Dye Formula 7
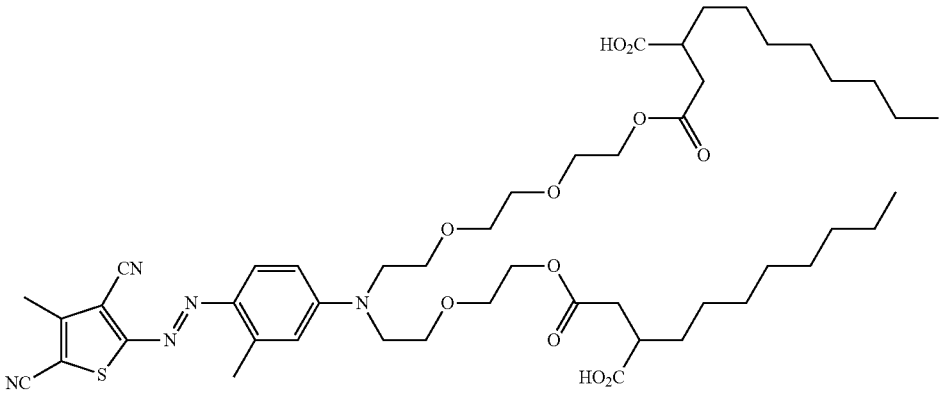
(HI = 6.7)
Dye Formula 8
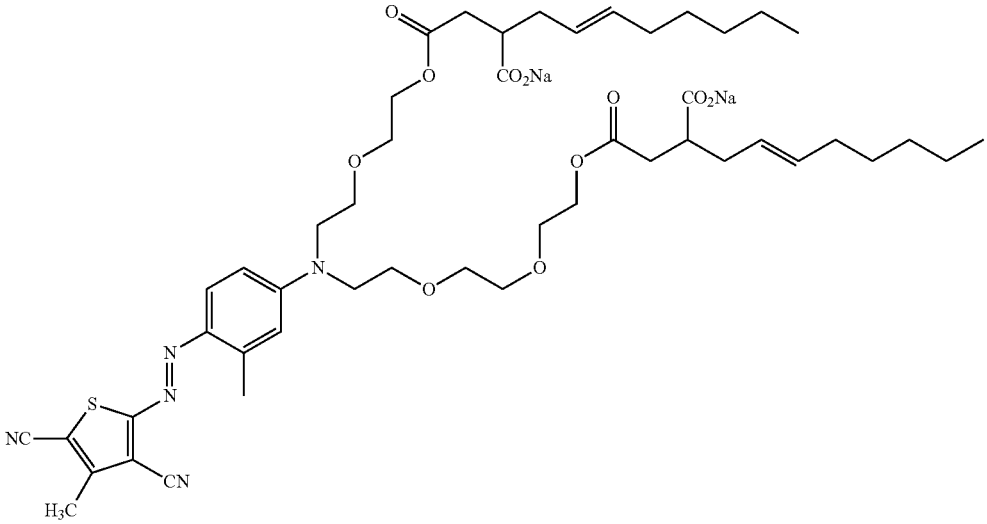
(HI = 6.7)

-continued

Dye Formula 9

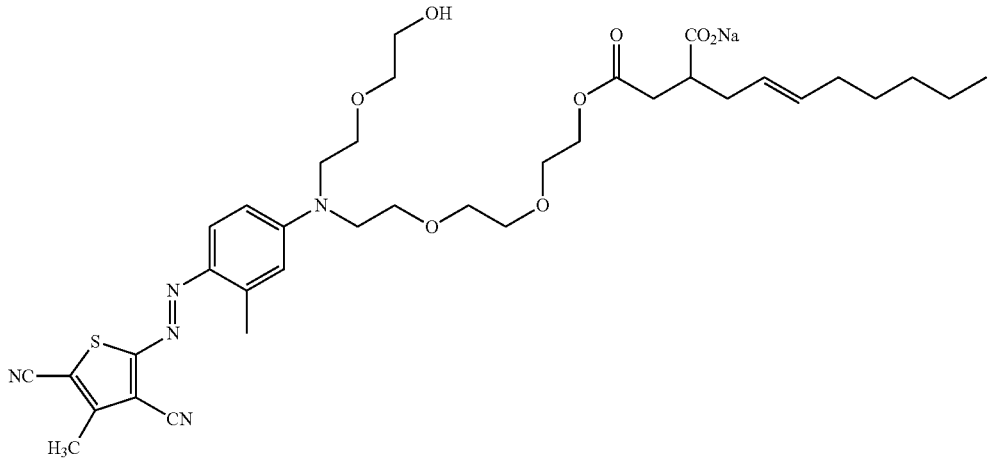

(HI = 7.5)

Dye Formula 10

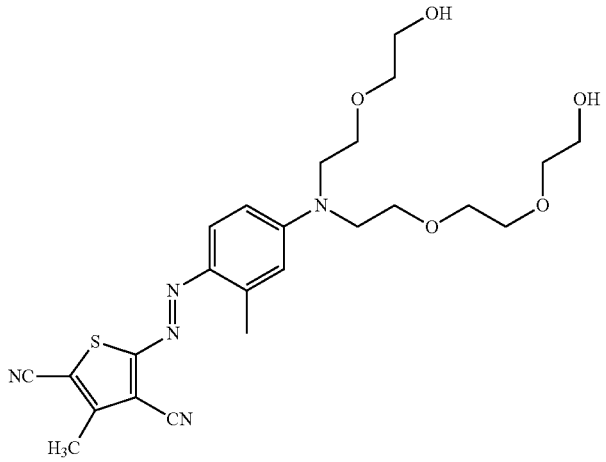

(HI = 8.9)

Suitable dye clay conjugates include dye clay conjugates selected from the group comprising at least one cationic/basic dye and a smectite clay; a preferred clay may be selected from the group consisting of Montmorillonite clay, Hectorite clay, Saponite clay and mixtures thereof. In another aspect, suitable dye clay conjugates include dye clay conjugates selected from the group consisting of a clay and one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11 In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Any suitable soil release polymer may be used. Those skilled in the art would recognise suitable soil release polymers. The soil release polymer may comprise a polyester soil release polymer. Suitable polyester soil release polymers may be selected from terephthalate polymers, amine polymers or mixtures thereof. Suitable polyester soil release polymers may have a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr—CO—]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is H, Na, Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or any mixture thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable polyester soil release polymers may be terephthalate polymers having the structure of formula (I) or (II) above.

Suitable polyester soil release polymers include the Repel-o-tex series of polymers such as Repel-o-tex SF2 (Rhodia) and/or the Texcare series of polymers such as Texcare SRA300 (Clariant).

Any suitable brightener may be used. Those skilled in the art would recognize suitable brighteners. The brightener is preferably selected from stilbene brighteners.

The brightener may comprise stilbenes, such as brightener 15. Other suitable brighteners include brightener 49. The brightener may be in micronized particulate form, having a weight average particle size in the range of from 3 to 30 micrometers, or from 3 micrometers to 20 micrometers, or from 3 to 10 micrometers. The brightener can be alpha or beta crystalline form.

Suitable brighteners include: di-styryl biphenyl compounds, e.g. Tinopal® CBS-X, di-amino stilbene di-sulfonic acid compounds, e.g. Tinopal® DMS pure Xtra and Blankophor® HRH, and Pyrazoline compounds, e.g. Blankophor® SN, and coumarin compounds, e.g. Tinopal® SWN.

Preferred brighteners are: sodium 2 (4-styryl-3-sulfophenyl)-2H-napthol[1,2-d]triazole, disodium 4,4'-bis{[(4-anilino-6-(N methyl-N-2 hydroxyethyl)amino 1,3,5-triazin-2-yl)]; amino}stilbene-2-2' disulfonate, disodium 4,4'-bis{[(4-anilino-6-morpholino-1,3,5-triazin-2-yl)]amino} stilbene-2-2' disulfonate, and disodium 4,4'-bis(2-sulfostyryl)biphenyl. A suitable fluorescent brightener is C.I. Fluorescent Brightener 260, which may be used in its beta or alpha crystalline forms, or a mixture of these forms.

Any suitable chelant may be used. Those skilled in the art would recognize suitable chelants. Suitable chelants may be selected from: diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid), hydroxyethane di(methylene phosphonic acid), and any combination thereof. A suitable chelant is ethylene diamine-N'N'-disuccinic acid (EDDS) and/or hydroxyethane diphosphonic acid (HEDP). The laundry treatment composition may comprise ethylene diamine-N'N'-disuccinic acid or salt thereof. The ethylene diamine-N'N'-disuccinic acid may be in S,S enantiomeric form. The composition may comprise 4,5-dihydroxy-m-benzenedisulfonic acid disodium salt, glutamic acid-N,N-diacetic acid (GLDA) and/or salts thereof, 2-hydroxypyridine-1-oxide, Trilon P™ available from BASF, Ludwigshafen, Germany. Suitable chelants may also be calcium carbonate crystal growth inhibitors. Suitable calcium carbonate crystal growth inhibitors may be selected from the group consisting of: 1-hydroxyethanediphosphonic acid (HEDP) and salts thereof; N,N-dicarboxymethyl-2-aminopentane-1,5-dioic acid and salts thereof; 2-phosphonobutane-1,2,4-tricarboxylic acid and salts thereof; and any combination thereof.

The composition may comprise a calcium carbonate crystal growth inhibitor, such as one selected from the group consisting of: 1-hydroxyethanediphosphonic acid (HEDP) and salts thereof; N,N-dicarboxymethyl-2-aminopentane-1,5-dioic acid and salts thereof; 2-phosphonobutane-1,2,4-tricarboxylic acid and salts thereof; and any combination thereof.

Alkoxylated Alkyl Surfactant System

The liquid composition comprises between 40% and 80% by weight of the composition of an alkoxylated alkyl surfactant system, wherein the alkoxylated alkyl surfactant comprise a first alkoxylated alkyl surfactant and a second alkoxylated alkyl surfactant. The liquid composition may comprise between 50% and 75% or even between 60% and 70% by weight of the composition of the alkoxylated alkyl surfactant system.

The first surfactant has the general structure R-A, where R is a linear or branched alkyl chain having a chain length of between 6 and 18 carbon atoms, A is at least one alkoxy group having an average degree of alkoxylation of between 2 and 12 and wherein the alkoxy group consists of identical repeat alkoxy groups or identical repeat alkoxy group blocks wherein a block comprises at least two alkoxy groups.

The first surfactant may be an anionic surfactant, a non-ionic surfactant or a mixture thereof. Preferably, the alkoxylated alkyl surfactant is a non-ionic alkoxylated alkyl surfactant.

The alkoxy chain of the first surfactant may comprise an ethoxylate group, butoxylate group, propoxylate group or a mixture thereof. The alkyl group of the first surfactant consists of identical repeat alkoxy groups or identical repeat alkoxy group blocks wherein a block comprises at least two alkoxy groups. For example, the alkoxy group could be EO-EO-EO-EO (where an 'EO' is an ethoxy group), or the alkoxy group could be the following repeat blocks [EO—BO]-[EO—BO]-]EO—BO] (where a 'BO' is an butoxy group), or a further example being [BO—PO-EO]—[BO—PO-EO]—[BO—PO-EO]. Further examples include the following repeat blocks [EO—PO] or [EO-EO—PO]. These are non-limiting examples and the skilled person would be aware of further repeat alkoxy blocks or repeat alkoxy groups.

The first surfactant is preferably selected from the group comprising fatty alcohol alkoxylates, Guerbet alcohol alkoxylates, oxo alcohol alkoxylates, alkyl phenol alcohol alkoxylates and mixtures thereof.

The alkyl chain of the first surfactant may comprise between 8 and 16 or even between 10 and 14 carbon atoms.

The average degree of alkoxylation of the first surfactant is preferably between 3 and 10, or even between 4 and 8.

Preferably, the first surfactant has a hydrophilic index of between 6 and 16, more preferably between 8 and 14. Where the first surfactant is a mixture of alkoxylated alkyl surfactants according to the definition of the first surfactant, each surfactant in the mixture has a hydrophilic index of between 6 and 16, more preferably between 8 and 14. Alternatively, the mixture of alkoxylated alkyl surfactants taken together may have a hydrophilic index of between 6 and 16, more preferably between 8 and 14. Those skilled in the art will know how to calculate the hydrophilic index using well known equations.

The hydrophilic index of a surfactant ($HI_S$) can be calculated as follows;

$$\text{HI of surfactant}_x(HI_{Sx}) = 20 \times (\text{MW of the hydrophilic part of}_x)/(\text{MW of}_x)$$

Those skilled in the art will know how to recognise the hydrophilic part and calculate the appropriate molecular weights (MW).

The hydrophilic index of a mixed surfactant system ($HI_{MS}$) can be calculated as follows;

$$HI_{MS} = \sum_{n=1}^{x} ((\text{Wt. fraction of } Sx)(HI\ Sx))$$

Preferably, the non-surfactant benefit agent has a hydrophilic index, and the first surfactant has a hydrophilic index and wherein the hydrophilic index of the non-surfactant benefit agent is within 0.5 and 2, or even within 0.7 and 1.5 or even within 0.8 and 1.2 times that of the hydrophilic index of the first surfactant.

The second surfactant has the general structure R'-E-C, wherein R' is a linear or branched alkyl chain having a chain length of between 6 and 18 carbon atoms, E is an ethoxy chain consisting of between 2 and 12 ethoxy groups and C is an end cap, wherein the end cap is selected from;

I. an alkyl chain consisting of between 1 and 8 alkoxy groups selected from propoxy groups, butoxy groups and a mixture thereof; or II. an —OH group; or III. a linear or branched alkyl chain of the general formula R"H herein R" consists of between 1 and 8 carbon atoms;

IV. or a mixture thereof.

The alkyl chain of the second surfactant may comprise between 8 and 16 or even between 10 and 14 carbon atoms.

The ethoxy chain of the second surfactant may consist of 3 to 10 or even 4 to 8 ethoxy groups.

The weight ratio of the first surfactant to the second surfactant may be from 5:1 to 1:8, or even from 3:1 to 1:7, or even from 2:1 to 1:6.

The alkyl alkoxylated surfactant of the treatment composition may comprise no more than 50 wt %, preferably no more than 40 wt %, or 30 wt %, or 20 wt % or even no more than 10 wt % of the total surfactant present in the unit dose article.

The liquid composition may comprise less than 2%, or even less than 1%, or even less than 0.5% by weight of the composition of an anionic surfactant.

Solvent

The composition comprises between 0% and 40% by weight of the composition of a solvent, wherein the solvent is selected from polar protic solvents, polar aprotic solvents or a mixture thereof. Preferably, the solvent is selected from polar protic solvents.

Polar protic solvents are solvents that possess OH or NH bonds and can participate in hydrogen bonding. Those skilled in the art will recognize suitable polar aprotic solvents. Preferably, the polar aprotic solvent is selected from the group comprising water, glycerol, monopropylene glycol, dipropylene glycol, ethanol, methanol, propanol, isopropanol and mixtures thereof.

Polar aprotic solvents are solvents that have a dielectric constant greater than 15 and do not contain OH or NH groups. Those skilled in the art will recognise suitable polar aprotic solvents.

Preferably the solvent is selected from the group comprising water, glycerol, monopropylene glycol and mixtures thereof.

Adjunct Ingredients

The liquid composition may comprise an adjunct ingredient. Suitable adjunct ingredients may be selected from polymers, surfactants, builders, dye transfer inhibiting agents, dispersants, enzymes, enzyme stabilizers, catalytic materials, bleach activators, polymeric dispersing agents, anti-redeposition agents, suds suppressors, dyes, opacifiers, additional perfume and perfume delivery systems, structure elasticizing agents, hydrotropes, processing aids and/or pigments.

The liquid composition may comprise an aesthetic dye, an opacifier, an enzyme or a mixture thereof.

The composition may comprise aesthetic dyes and/or pigments. Suitable dyes include any conventional dye, typically small molecule or polymeric, used for colouring cleaning and/or treatment compositions. These are generally non-fabric hueing dyes.

The composition may comprise a rheology modifier. The rheology modifier may be selected from non-polymeric or polymeric rheology modifiers. The rheology modifier may be a non-polymeric rheology modifier, preferably a crystallisable glyceride. The rheology modifier may be a polymeric rheology modifier, preferably a fibre based polymeric rheology modifier, more preferably a cellulose fibre-based rheology modifier. The rheology modifier may be selected from acrylate-based polymers including acrylate homopolymers or acrylate containing co-polymers. The rheology modifier may be selected from crystallisable glyceride, cellulose-fibre based structurants, $TiO_2$, silica and mixtures thereof.

The composition may comprise a pearlescent agent.

Water-Soluble Film

The film of the present invention is soluble or dispersible in water. The water-soluble film preferably has a thickness of from 20 to 150 micron, preferably 35 to 125 micron, even more preferably 50 to 110 micron, most preferably about 76 micron.

Preferably, the film has a water-solubility of at least 50%, preferably at least 75% or even at least 95%, as measured by the method set out here after using a glass-filter with a maximum pore size of 20 microns:

50 grams±0.1 gram of film material is added in a preweighed 400 ml beaker and 245 ml±1 ml of distilled water is added. This is stirred vigorously on a magnetic stirrer, Labline model No. 1250 or equivalent and 5 cm magnetic stirrer, set at 600 rpm, for 30 minutes at 24° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310.

Of the total PVA resin content in the film described herein, the PVA resin can comprise about 30 to about 85 wt % of the first PVA polymer, or about 45 to about 55 wt % of the first PVA polymer. For example, the PVA resin can contain about 50 w. % of each PVA polymer, wherein the viscosity of the first PVA polymer is about 13 cP and the viscosity of the second PVA polymer is about 23 cP.

Naturally, different film material and/or films of different thickness may be employed in making the compartments of the present invention. A benefit in selecting different films is that the resulting compartments may exhibit different solubility or release characteristics.

The film material herein can also comprise one or more additive ingredients. For example, it can be beneficial to add plasticisers, for example glycerol, ethylene glycol, diethyleneglycol, propylene glycol, sorbitol and mixtures thereof. Other additives may include water and functional detergent additives, including surfactant, to be delivered to the wash water, for example organic polymeric dispersants, etc.

The film may be opaque, transparent or translucent. The film may comprise a printed area. The printed area may cover between 10 and 80% of the surface of the film; or between 10 and 80% of the surface of the film that is in contact with the internal space of the compartment; or between 10 and 80% of the surface of the film and between 10 and 80% of the surface of the compartment.

The area of print may cover an uninterrupted portion of the film or it may cover parts thereof, i.e. comprise smaller areas of print, the sum of which represents between 10 and 80% of the surface of the film or the surface of the film in contact with the internal space of the compartment or both.

The area of print may comprise inks, pigments, dyes, blueing agents or mixtures thereof. The area of print may be opaque, translucent or transparent.

The area of print may comprise a single colour or maybe comprise multiple colours, even three colours. The area of print may comprise white, black, blue, red colours, or a mixture thereof. The print may be present as a layer on the surface of the film or may at least partially penetrate into the film. The film will comprise a first side and a second side. The area of print may be present on either side of the film, or be present on both sides of the film. Alternatively, the area of print may be at least partially comprised within the film itself.

The area of print may comprise an ink, wherein the ink comprises a pigment. The ink for printing onto the film has preferably a desired dispersion grade in water. The ink may be of any color including white, red, and black. The ink may be a water-based ink comprising from 10% to 80% or from 20% to 60% or from 25% to 45% per weight of water. The ink may comprise from 20% to 90% or from 40% to 80% or from 50% to 75% per weight of solid.

The ink may have a viscosity measured at 20° C. with a shear rate of 1000 $s^{-1}$ between 1 and 600 cPs or between 50 and 350 cPs or between 100 and 300 cPs or between 150 and 250 cPs. The measurement may be obtained with a cone-plate geometry on a TA instruments AR-550 Rheometer.

The area of print may be achieved using standard techniques, such as flexographic printing or inkjet printing. Preferably, the area of print is achieved via flexographic printing, in which a film is printed, then moulded into the shape of an open compartment. This compartment is then filled with a treatment composition and a second film placed over the compartment and sealed to the first film. The area of print may be on either or both sides of the film.

Alternatively, an ink or pigment may be added during the manufacture of the film such that all or at least part of the film is coloured.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

The composition may be present at between 1% and 50% by weight of the unit dose article. The composition may be present in one single compartment of the unit dose article, and the other compartments comprise different compositions. Without wishing to be bound by theory, it is often beneficial to separate incompatible ingredients in a unit dose article by formulating them into different compartments. This results in high concentrations of a particular active material in a particular compartment that results in localized high concentrations of material in the wash liquor. Therefore, it was surprisingly found that the formulation of the composition of the present invention into at least one compartment of a unit dose article resulted in reduced instances of localized high concentrations of benefit agents in the wash liquor.

Method of Making

The water-soluble unit dose article of the present invention may be made using any suitable manufacturing techniques known in the art. Those skilled in the art would know appropriate methods and equipment to make the composition according to the present invention.

Method of Use

The unit dose article of the present invention can be added to a wash liquor to which laundry is already present, or to which laundry is added. It may be used in a washing machine operation and added directly to the drum or to the dispenser drawer. The washing machine may be an automatic or semi-automatic washing machine. It may be used in combination with other laundry treatment compositions such as fabric softeners or stain removers. It may be used as pre-treat composition on a stain prior to being added to a wash liquor.

Examples

The laundry treatment composition of the unit dose article of the present invention was compared to a comparative composition.

Composition A according to the present invention was prepared as follows;

| Composition A | |
|---|---|
| 1,2 Propane-diol | 7.6 wt % |
| Glycerol | 5.0 wt % |
| alkyl alkoxylated alcohol (C13-15-EO-BO) commercially supplied as Plurafac LF223 | 27.3 wt % |
| alkyl branched ethoxylated alcohol (C10-EO4) commercially supplied as Lutensol XP40 | 40.0 wt % |
| Water | 5.9 wt % |
| linear alkyl ethoxylate hueing dye present as a 12 wt % active in 1,2-propanediol | 10 wt % |
| Acrylate/styrene opacifier commercially available as OP305; 30 wt % active in 1,2-propanediol | 4.2 wt % |

Composition A was compared to commercially available Composition B which had the following published formulation;

| Composition B | |
|---|---|
| water | 2 to 6 wt % |
| 1,2 PropaneDiol | 7 to 13 wt % |
| Glycerine | 3 to 8 wt % |
| Linear alkylbenzene sulphonic acid | 18 to 25 wt % |
| Ethoxylated alkyl sulphate anionic surfactant | 7 to 14 wt % |
| Non-ionic surfactant with an average degree of alkoxylation of 9 | 15 to 22 wt % |
| Citric acid | 0.5 to 2 wt % |
| Fatty acid | 5 to 9 wt % |
| DTPA | 0.5 to 2 wt % |
| PEI polymer | 4 to 9 wt % |
| Minors | 1 to 3 wt % |
| monoethanolamine (MEA) | 6 to 10 wt % |
| alkyl ethoxylate hueing dye present as a 12 wt % active solution of the hueing dye in 1,2-propanediol | 10 wt % |

For each composition, the following test was run;

1. Round, clean, white, cotton fabrics at the size of the well plate's cavity are placed in 96-wellplate.
2. Pre-wet the fabrics using a very small volume of demin water.
3. Then pipette an excess amount (200 uL) of the formulated products on top of the pre-wetted fabrics.
4. Incubation at 25° C. of the fabrics and formulated products for 45 mins.
5. After this, the formulated products are removed (pipetted off).
6. Any formulated product residues are washed off using a generic Liquid Laundry detergent solution during a 15 mins wash cycle at 25 C.
7. The wash water is fully removed (pipetted off).
8. Finally the fabrics are put through 3 short, consecutive rinse cycles (30 secs each) with demin water.
9. The rinse water is fully removed (pipetted off).
10. Wellplates are placed in the oven at 35 deg C. to allow the fabrics to dry.
11. A picture of the wellplates holding the dry, stained fabrics is taken using the Digi-Eye instrument.
12. Image analysis is performed to assess the discoloration of the fabric versus the untreated fabrics (for e.g. delta E is reported).

A higher dE corresponds to a higher degree of staining. Results can be seen in Table 1 below

TABLE 1

| Formula | dE |
|---|---|
| Composition A | 2.04 |
| Composition B | 9.43 |

As can be seen from Table 1, Composition A according to the present invention exhibited a lower dE and so resulted in a lower degree of fabric staining than comparative Composition B.

The following are examples of laundry treatment compositions that can be formulated in unit dose articles of the present invention. Preferably the following formulations are formulated into a single compartment on a multicompartment unit dose article.

| | 1 (wt %) | 2 (wt %) | 3 (wt %) | 4 (wt %) |
|---|---|---|---|---|
| 1,2 propane diol | 7.6 | 10.0 | 2.0 | 5.1 |
| Glycerol | 5.0 | 5.0 | 1.0 | 8.0 |
| Plurafac LF223 | 27.3 | 63.0 | 53.0 | 15.4 |
| Lutensol XP40 | 40.0 | 10.0 | 27.0 | 50.0 |
| Water | 5.9 | 2.0 | 3.0 | 7.0 |
| alkyl ethoxylate hueing dye present as a 12 wt % active solution of the hueing dye in 1,2-propanediol | 10.0 | 10.0 | 10.0 | 10.0 |
| Acrylate/styrene opacifier commercially available as OP305; 60 wt % active in 1,2-propanediol | 4.2 | — | 4.0 | 4.5 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A water-soluble unit dose article comprising a water-soluble film and a laundry treatment composition, wherein said laundry treatment composition comprises:

a. between about 0.0001% and about 8% by weight of the composition of a hueing dye, wherein the hueing dye is in a chemical class selected from the group consisting of acridine, anthraquinone, azine, azo, benzodifurane, benzodifuranone, carotenoid, cyanine, diazahemicyanine, diphenylmethane, formazan, hemicyanine, indigoids, methane, naphthoquinone, nitro, nitroso, oxazine, phthalocyanine, pyrazoles, triarylmethane, triphenylmethane, xanthenes, and mixtures thereof;

b. between about 40% and about 80% by weight of the composition of an alkoxylated alkyl surfactant system, wherein the alkoxylated alkyl surfactant comprise a first alkyloxylated alkyl surfactant and a second alkoxylated alkyl surfactant, wherein;

i. the first surfactant has the general structure R-A, where R is a linear or branched alkyl chain having a chain length of between about 6 and about 18 carbon atoms, A is at least one alkoxy group having an average degree of alkoxylation of between about 2 and about 12 and wherein the alkoxy groups consist of identical repeat alkoxy groups or identical repeat alkoxy group blocks wherein a block comprises at least two alkoxy groups;

ii. the second surfactant has the general structure R'-E-C, wherein R' is a linear or branched alkyl chain having a chain length of between about 6 and about 18 carbon atoms, E is an ethoxy chain consisting of between about 2 and about 12 ethoxy groups and C is an end cap, wherein the end cap is selected from;

I. an alkyl chain consisting of between about 1 and about 8 alkoxy groups selected from propoxy groups, butoxy groups and a mixture thereof;

II. an —OH group;

III. a linear or branched alkyl chain of the general formula R" wherein R" comprises between about 1 and about 8 carbon atoms;

IV. or a mixture thereof;

c. between 0% and about 40% by weight of the composition of a solvent, wherein the solvent is selected from polar protic solvents, polar aprotic solvents or a mixture thereof.

2. The unit dose article according to claim 1, wherein the weight ratio of the first surfactant to the second surfactant is about 5:1 to about 1:8.

3. The unit dose article according to claim 1, wherein the alkoxy chain of the first surfactant comprises an ethoxylate group, butoxylate group, propoxylate group or a mixture thereof.

4. The unit dose article according to claim 1 wherein the first surfactant is selected from the group consisting of fatty alcohol alkoxylates, Guerbet alcohol alkoxylates, oxo alcohol alkoxylates, alkyl phenol alcohol alkoxylates and mixtures thereof.

5. The unit dose article according to claim 1 wherein the alkyl chain of the first surfactant, the second surfactant or both surfactants comprises between about 8 and about 16.

6. The unit dose article according to claim 1 wherein the average degree of alkoxylation of the first surfactant is between about 3 and about 10.

7. The unit dose article according to claim 1 wherein the ethoxy chain of the second surfactant consists of about 3 to about 10 ethoxy groups.

8. The unit dose article according to claim 1 wherein the end cap of the second surfactant consists of between about 1 and about 6 alkoxy groups selected from propoxy groups, butoxy groups and a mixture thereof.

9. The unit dose article according to claim 1 wherein the treatment composition comprises between about 50% and about 75% by weight of the composition of the alkoxylated alkyl surfactant system.

10. The unit dose article according to claim 1 wherein the first surfactant, second surfactant or a mixture thereof is a non-ionic surfactant.

11. The unit dose article according to claim 1 wherein the composition comprises less than about 2% by weight of the composition of an anionic surfactant.

12. The unit dose article according to claim 1 comprising between about 0.0005% and about 6% by weight of the composition of the hueing dye.

13. The unit dose article according to claim 1 wherein the hueing dye has a hydrophilic index, and the first surfactant has a hydrophilic index and wherein the hydrophilic index of the non-surfactant benefit agent is within about 0.5 and about 2 times that of the hydrophilic index of the first surfactant.

14. The unit dose article according to claim 1 further comprising an aesthetic dye, an opacifier, an enzyme, a pearlescent agent, a rheology modifier or a mixture thereof.

15. The unit dose article according to claim 1 wherein the laundry treatment composition is in the form of a solid, a liquid or a mixture thereof.

16. The unit dose article according to claim 1 wherein said unit dose article comprises at least two compartments, and the composition is contained within at least one of the compartments.

17. The unit dose article according to claim 1 wherein the composition is present at between about 1% and about 50% by weight of the unit dose article.

18. The unit dose article according to claim 1 wherein the alkyl alkoxylated surfactant of the treatment composition comprises no more than about 50 wt % of the total surfactant present in the unit dose article.

19. A process of laundering fabrics comprising the step of adding the unit dose article of claim 1 to an automatic washing machine with fabrics to be laundered.

20. The unit dose article according to claim 1, wherein the hueing dye is in a chemical class selected from the group consisting of azo, triarylmethane, triphenylmethane, and mixtures thereof.

* * * * *